US006003495A

United States Patent [19]

Tipton et al.

[11] Patent Number: 6,003,495

[45] Date of Patent: Dec. 21, 1999

[54] METHOD AND APPARATUS FOR LIMITING FUEL LEAKAGE THROUGH INJECTORS AFTER ENGINE SHUTDOWN

[75] Inventors: Larry J. Tipton, Kokomo; David E. Winn, Royal Center, both of Ind.

[73] Assignee: Federal-Mogul World Wide, Inc., Southfield, Mich.

[21] Appl. No.: 09/078,240

[22] Filed: May 13, 1998

[51] Int. Cl.[6] ..... F02M 41/00

[52] U.S. Cl. ..... 123/467

[58] Field of Search ..... 123/467, 198 DB, 123/458

[56] References Cited

U.S. PATENT DOCUMENTS

| | | | |
|---|---|---|---|
| 5,074,272 | 12/1991 | Bostick et al. | 123/467 |
| 5,159,911 | 11/1992 | Williams et al. | 123/467 |
| 5,389,245 | 2/1995 | Jaeger et al. | 210/129 |
| 5,408,970 | 4/1995 | Burkhard et al. | 123/467 |
| 5,586,539 | 12/1996 | Yonekawa et al. | 123/458 |
| 5,630,399 | 5/1997 | Nomura et al. | 123/467 |
| 5,672,051 | 9/1997 | Forgue et al. | 417/44 |
| 5,845,623 | 12/1998 | Blizard et al. | 123/467 |

*Primary Examiner*—Thomas N. Moulis
*Attorney, Agent, or Firm*—Jon E. Shackelford

[57] ABSTRACT

In operation, the main pump (24) is activated and the main value (18) is opened in response to the ignition switch (28) being turned ON to pump fuel from the fuel supply tank (12) to the injectors in the injector manifold (14). During the ON condition, the return control valve (48) is closed to prevent back flow from the injector manifold (14) to the fuel tank (12). In response to the ignition switch (28) being turned to the OFF condition, the main valve (18) is closed and the main pump (24) is deactivated and, most importantly, the return control valve (48) is opened and the return pump (40) is activated to place a negative or vacuum pressure on the upstream side of the injectors to return the residual fuel therein to the fuel tank (12). This prevents the residual fuel from leaking through the injectors and into the combustion chambers of the engine (10), which, in turn, would make it difficult to immediately restart the engine (10) because of a fuel rich condition.

10 Claims, 1 Drawing Sheet

METHOD AND APPARATUS FOR LIMITING FUEL LEAKAGE THROUGH INJECTORS AFTER ENGINE SHUTDOWN

BACKGROUND OF THE INVENTION

1. Field of the Invention

The subject invention relates to a fuel injection system including a fuel pump which pumps fuel from a fuel tank through an electronic control valve and to the fuel injectors in an internal combustion engine.

2. Description of the Prior Art

The injectors are frequently fed fuel from a common rail which, in turn, receives fuel from an electronic control valve. The fuel is pumped through the electronic fuel valve by a pump and the electronic fuel valve is closed to terminate flow in response to the ignition system being turned off. However, the residual pressure between the electronic fuel valve and the injectors is sufficient for fuel to leak through the injectors and into the combustion chambers thereby causing a fuel rich or "flooded" condition which impedes an engine re-start.

The U.S. Pat. No. 5,630,399, granted May 20, 1997, to Nomura et al. addresses this problem by placing a relief valve in the supply line to the injectors.

SUMMARY OF THE INVENTION AND ADVANTAGES

The invention provides a unique method of limiting the leakage of fuel through the injectors and into the combustion chambers of an internal combustion engine after engine shutdown from normal operation during which fuel is supplied to the fuel injector on the upstream side thereof. The method is characterized by applying a negative fuel pressure to the upstream side of the injector in response to engine shutdown to remove fuel on the upstream side of the injector which could leak through the injector and into the combustion chamber after engine shutdown.

A fuel injection assembly for performing the method is characterized by a supply system for supplying fuel to the upstream side of the fuel injector during normal operation of the engine and for applying a negative fuel pressure to the upstream side of the injector in response to engine shutdown to remove fuel on the upstream side of the injector which could leak through the injector and into the combustion chamber after engine shutdown.

BRIEF DESCRIPTION OF THE DRAWING

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
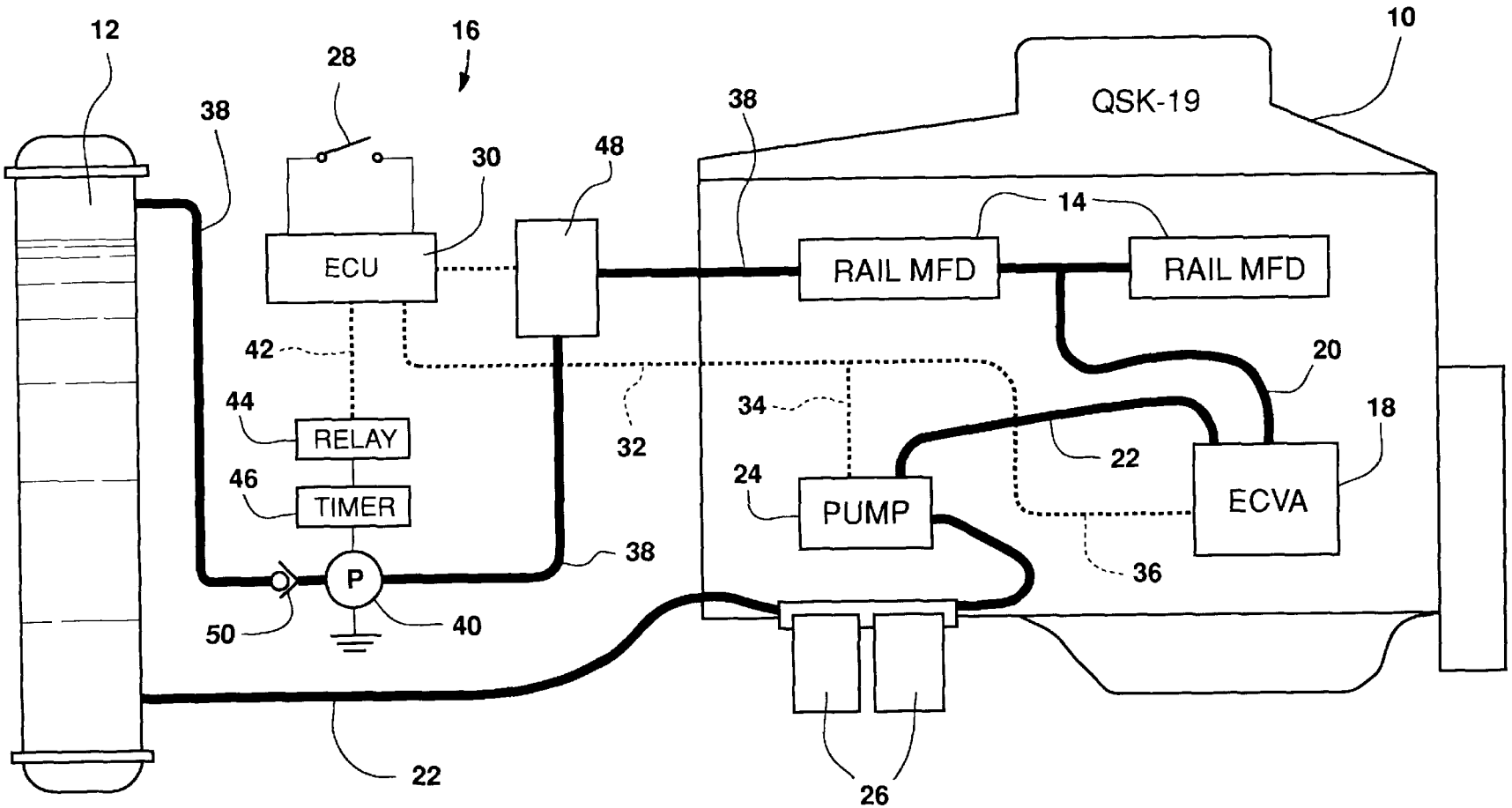
FIG. 1 is a schematic view of a preferred embodiment of the subject invention.

FIG. 1 schematically discloses the well components associated with an internal combustion diesel engine 10. As is well known in the art, a fuel injection assembly supplies fuel from a fuel supply tank 12 to a rail manifolds 14 of the engine 10. The manifolds 14 include a plurality of fuel injectors each having an upstream side for receiving fuel and a downstream side for injecting fuel into the combustion chamber of the internal combustion engine.

The assembly is characterized by a supply system 16 for supplying fuel to the upstream side the fuel injector during normal operation of the engine 10 and for applying a negative fuel pressure to the upstream side of the injector in response to engine shutdown to remove fuel on the upstream side of the injector which could leak through the injector and into the combustion chamber after engine shutdown. In addition to the fuel tank 12, the assembly includes a main valve 18 movable between open and closed positions for allowing fuel flow to the injector in the open position and for terminating fuel flow to the injector in the closed position and an injector fuel line 20 for delivering fuel from the main valve 18 to the injector. The main valve 18 is typically an electronic control valve well known for such a use. The fuel tank 12 stores and supplies fuel to the main valve 18 through a main fuel line 22, i.e., the main fuel line 22 for establishes fuel flow between the fuel tank 12 and the main valve 18. A main pump 24 is disposed in the main fuel line 22 for supplying fuel to the injector during normal operation of the engine 10. A pair of filters 26 are also disposed in the main fuel line 22 as is well known in the art.

The assembly includes a switch 28 having an engine ON or closed condition for establishing the normal operation of the engine 10 and an engine OFF or open condition for establishing the engine shutdown, i.e., ignition on and ignition off. The switch 28 is connected to and operates an electronic control unit 30. The main valve 18 is opened and the main pump 24 is activated to pump fuel in response to the switch 28 being in the ON condition through electrical connections 32, 34 and 36 with the electronic control unit 30.

The supply system 16 includes a return fuel line 38 connected in fluid communication between the injector fuel line 20 and the fuel tank 12 and a return pump 40 disposed in the return fuel line 38 and having a vacuum mode of operation for establishing the negative fuel pressure, i.e., a vacuum mode to return fuel from the injector fuel line 20 to the fuel tank 12. The return pump 40 is also controlled by the electronic control unit 30 through an electrical lead 42, which also places a relay 44 and a timer 46 in series with the return pump 40. A return control valve 48 is disposed in the return line 38 for closing the return line 38 during operation of the main pump 24 to prevent return of fuel to the fuel tank 12 normal operation of the engine 10 in response to the switch 28 being in the ON condition. In addition, a check valve 50 is disposed in the return line 38 between the return pump 40 and the fuel tank 12 for preventing fuel flow from the fuel tank 12 through the return pump 40.

In operation, the main pump 24 is activated and the main valve 18 is opened in response to the ignition switch 28 being turned ON to pump fuel from the fuel tank 12 to the injectors in the injector manifold 14. During the ON condition, the return control valve 48 is closed to prevent back flow from the injector manifold 14 to the fuel tank 12.

In response to the ignition switch 28 being turned to the OFF condition, the main valve 18 is closed and the main pump 24 is deactivated and, most importantly, the return control valve 48 is opened and the return pump 40 is activated to place a negative or vacuum pressure on the upstream side of the injectors to return the residual fuel therein to the fuel tank 12. This prevents the residual fuel from leaking through the injectors and into the combustion chambers of the engine 10, which, in turn, would make it difficult to immediately restart the engine 10 because of a fuel rich condition. The control unit 30 is connected to the main valve 18 and the return control valve 48 for maintaining one valve closed while the other valve is open, and vice versa. As the electronic control unit 30 places the return pump 40 in the vacuum mode in response to the switch 28 moving from the ON condition to the OFF condition, it simultaneously activates the timer 46 for terminating operation of the return pump 40 in the vacuum mode a predetermined time period after the switch 28 is moved from the ON condition to the OFF condition.

The above embodiment is particularly suited for an add-on situation, as in the automotive aftermarket, whereas the concept encompasses use of the invention in an OEM situation as original equipment. In the later embodiment, the return line 38 and return pump 40 would be replaced by a main pump 24 which would be a reversible pump and electronic control valve 18 would have a bypass so that the electronic control unit 30 would simply reposition the electronic control valve 18 to a return by-pass position and reverse the direction of pumping by the main pump 24. In either case, a pump would be activated to positively apply a pressure to the residual fuel at the upstream side of the injectors immediately after engine shutdown. In the embodiment illustrated, the method of implementation is characterized by placing a control valve having a normally closed condition in fluid communication with the injector fuel line 20 and placing a return pump 40 in fluid communication with the control valve. It is further refined by installing a control unit 30 with the return pump 40 and control valve to open the control valve during operation of the return pump 40 and installing a timer 46 with the control unit 30 to cease operation of the return pump 40 after a predetermined time period. In the second embodiment, the implementation is by installing a reversible main pump 24 with a main valve 18 which can be controlled to reverse fuel flow in response to engine shutdown.

Within the bounds of the appended claims are various modifications. The return pump 40 and the solenoid 48 may be replaced with a single positive displacement pump which will prevent backflow. Alternatively, a pumping solenoid could replace the return pump 40 and solenoid 48. Additionally, the relay 44 and timer 46 may be part of the circuit board in the return pump 40.

The invention provides a method of supplying fuel to the fuel injector on the upstream side thereof during normal operation of an internal combustion engine 10 which is characterized by applying a negative fuel pressure to the upstream side of the injector in response to engine shutdown to remove fuel on the upstream side of the injector which could leak through the injector and into the combustion chamber after engine shutdown. The negative pressure is specifically attained by operating a return pump 40 in vacuum mode. A further step includes timing the operation of the return pump 40 and terminating operation of the pump after a predetermined time period. The method is further defined as preventing the return fuel from the injector fuel line 20 to the pump 40 during normal operation of the engine 10.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A fuel injection assembly comprising:

a fuel injector having an upstream side for receiving fuel and a downstream side for injecting fuel into the combustion chamber of an internal combustion engine (10), a supply system (16) including a main pump (24) for supplying fuel to said upstream side said fuel injector during normal operation of the engine (10) and a return pump (40) having a pumping mode of operation for applying a negative fuel pressure to said upstream side of said injector in response to engine shutdown and after shutdown of said main pump to remove fuel on said upstream side of said injector which could leak through said injector and into the combustion chamber after engine shutdown, a switch (28) having an engine ON condition for establishing the normal operation of the engine (10) and an engine OFF condition for establishing the engine shutdown, and a control unit (30) for placing said return pump (40) in said pumping mode in response to said switch (28) moving from said ON condition to said OFF condition and for placing said return pump (40) in a non-pumping mode in response to said switch (28) moving from said OFF condition to said ON condition.

2. An assembly as set forth in claim 1 wherein said system (16) includes a main valve (18) movable between open and closed positions for allowing fuel flow to said injector in said open position and for terminating fuel flow to said injector in said closed position, and an injector fuel line (20) for delivering fuel from said main valve (18) to said injector, said return pump (40) being connected in fluid communication with said injector fuel line (20) for removing fuel therefrom in said vacuum mode.

3. An assembly as set forth in claim 2 wherein said fuel system (16) includes a fuel tank (12) for storing and supplying fuel to said main valve (18), and a return fuel line (38) connected in fluid communication between said injector fuel line (20) and said fuel tank (12), said return pump (40) being in said return fuel line (38) in said vacuum mode to return fuel from said injector fuel line (20) to said fuel tank (12).

4. A fuel injection assembly comprising:

a fuel injector having an upstream side for receiving fuel and a downstream side for injecting fuel into the combustion chamber of an internal combustion engine (10), a supply system (16) for supplying fuel to said upstream side said fuel injector during normal operation of the engine (10) and for applying a negative fuel pressure to said upstream side of said injector in response to engine shutdown to remove fuel on said upstream side of said injector which could leak through said injector and into the combustion chamber after engine shutdown, said supply system (16) including a return pump (40) having a vacuum mode of operation for establishing said negative fuel pressure, a switch (28) having an engine ON condition for establishing the normal operation of the engine (10) and an engine OFF condition for establishing the engine shutdown, said system (16) including a timer (46) for terminating operation of said return pump (40) in said vacuum mode a predetermined time period after said switch (28) is moved from said ON condition to said OFF condition.

5. An assembly as set forth in claim 3 wherein said system (16) includes a main fuel line (22) for establishing fuel flow between said fuel tank (12) and said main valve (18), and a main pump (24) in said main fuel line (22) for supplying fuel to said injector during normal operation of the engine (10) in response to said switch (28) being in said ON condition.

6. An assembly as set forth in claim 5 including a control valve (18) in said return line (38) for closing said return line (38) during operation of said main pump (24) to prevent return of fuel to said fuel tank (12) normal operation of the engine (10) in response to said switch (28) being in said ON condition.

7. An assembly as set forth in claim 6 wherein said control unit (30) is connected to said main valve (18) and said control valve (18) for maintaining one valve closed while the other valve is open, and vice versa.

8. An assembly for retrieving fuel upstream of a fuel injector for an internal combustion engine (10) wherein fuel is pumped from a fuel storage tank (12) through a main valve (18) to an injector fuel line (20) during an engine ON condition for normal operation and wherein the main valve (18) is closed during an engine OFF condition for engine shutdown, said assembly characterized by the combination of a return pump (40) in fluid communication with said injector fuel line (20) and having a vacuum mode for applying a negative pressure to the injector fuel line (20) to said return pump (40), a control unit (30) for opening said control valve (18) and for initiating operation of said return pump (40) to apply a negative pressure and draw fuel from said injector fuel line (20) in response to the engine (10) moving from the ON condition to the OFF condition, and a timer (46) for terminating operation of said return pump (40) a predetermined time period after said control unit (30) initiates operation of said return pump (40).

9. A method of supplying fuel to the injectors of an internal combustion engine (10) during normal operation of the engine (10) and after engine shutdown and including the step of supplying fuel to the fuel injector on the upstream side thereof during normal operation of the engine (10), said method characterized by operating a return pump (40) in a vacuum mode to apply a negative fuel pressure to the upstream side of the injector which could leak through the injector and into the combustion chamber after engine shutdown, and timing the operation of the pump (40) and terminating operation of the pump (40) after a predetermined time period.

10. A method as set forth in claim 9 further defined as preventing the return fuel from the injector fuel line (20) to the return pump (40) during normal operation of the engine (10).

* * * * *